United States Patent [19]

Isaka et al.

[11] Patent Number: 4,818,913

[45] Date of Patent: Apr. 4, 1989

[54] AGING METHOD FOR THIN-FILM ELECTROLUMINESCENT DISPLAY PANEL

[75] Inventors: Kinishi Isaka, Yamatokoriayama; Masashi Kawaguchi, Nara; Hisashi Uede, Yamatokoriyama, all of Japan

[73] Assignee: Sharp Kabushiki Kaisha, Osaka, Japan

[21] Appl. No.: 401,385

[22] Filed: Jul. 23, 1982

[30] Foreign Application Priority Data

Jul. 31, 1981 [JP] Japan ..... 56-121001
Jul. 31, 1981 [JP] Japan ..... 56-121002

[51] Int. Cl.[4] ..... H01J 9/44; H05B 33/10

[52] U.S. Cl. ..... 315/169.3; 313/498; 315/246; 445/6

[58] Field of Search ..... 315/246, 169.3; 313/498; 340/760, 781; 445/6

[56] References Cited

U.S. PATENT DOCUMENTS 3,185,893 5/1965 Sperling ..... 315/246
3,708,708 1/1973 Soxman ..... 313/503 X
3,731,353 5/1973 Vecht ..... 445/6
4,275,336 6/1981 Marrello et al. ..... 315/246
4,412,155 10/1983 Isaka et al. ..... 315/246

*Primary Examiner*—Leo H. Boudreau
*Assistant Examiner*—K. Wieder
*Attorney, Agent, or Firm*—Birch, Stewart, Kolasch & Birch

[57] ABSTRACT

A method of aging a thin-film electroluminescent (EL) display element comprises the steps of applying an aging voltage to electrodes of the element, and changing the peak value of the aging voltage in accordance with the characteristics of the element which change during an aging period. An aging circuit to perform the above method is provided. In a specific example, the magnitude of the aging voltage is changed according to the relationship between the brightness of electroluminescence generated from the element and a driving voltage applied to the element. In another specific example, the magnitude of the aging voltage is changed such that the brightness of the electroluminescence is sustained to be substantially constant, thereby making operation points constant on the above characteristics.

3 Claims, 2 Drawing Sheets

AGING METHOD FOR THIN-FILM ELECTROLUMINESCENT DISPLAY PANEL

BACKGROUND OF THE INVENTION

The present invention relates to a thin-film electroluminescent (referred to as "EL" hereinbelow) display panel and, more particularly, to a method for aging such a thin-film EL display panel.

Firstly, a conventional electroluminescent (EL) display panel is illustrated in FIG. 1, wherein the EL display panel comprises a first transparent glass substrate 1, a transparent electrode 2 made of $In_2O_3$, $SnO_2$ etc. formed thereon, a first dielectric layer 3 made of $Y_2O_3$, $TiO_2$, $Si_3N_4$, $SiO_2$, etc., an EL thin film 4 made of ZnS:Mn, and a second dielectric layer 5 made of a material similar to the first dielectric layer 3. A counter electrode 6 is made of Al and is formed on the second dielectric layer 5 through evaporation techniques. The first dielectric layer 3 is provided by sputtering or electron beam evaporation techniques. The EL thin film 4 is made of a ZnS thin film doped with manganese at a desired amount. An AC electric field from an AC power source 7 is applied to the transparent electrode 2 and the counter electrode 6 to activate the EL thin film 4.

The EL thin film 4 is fabricated by electron beam evaporating a ZnS sintered pellet doped with Mn at a preferable quantity and, then, by heat-treating it in vacuum or an inert gas atmosphere. Mn serves as a luminescent center in the EL thin film 4.

It is necessary so conduct an aging procedure, with a voltage applied, on the thin-film EL display panel so as to stabilize its optical properties such as brightness of emitted light, and its physical properties such as dielectric breakdown properties.

In order to shorten a time required to complete the aging procedure, it was generally presumed that the magnitude, pulse width, and/or frequency etc., of the voltage applied to electrode means of the thin-film EL display panel became higher.

However, if this was actually conducted, a disadvantage was the generation of remarkable dielectric breakdown.

In view of the foregoing, it was usual that the aging procedure was conducted with a constant AC voltage lower than a voltage applied to provide electroluminescence. As a result, a long time of about 50–60 hours was conventionally required to complete the aging procedure.

Further, according to the conventional aging procedure, properties for representing the relation between emission brightness of the electroluminescence and the voltage applied to the thin-film EL display panel (which is referred to as "B-V" properties hereinafter) vary during the aging procedure. This varies the aging efficiency with the lapse of time while a constant voltage is applied across the transparent electrode 2 and the counter electrode 6 for aging purposes.

FIG. 2 shows a graph of the B-V properties of the thin-film EL display panel which is subjected to the conventional aging procedure in which a constant voltage is applied across the electrodes. In the graph of FIG. 2, the respective data are related to the following conditions:

$l_1$: before the aging procedure $l_2$: at about 1 hour after the aging procedure $l_3$: at abut 3 hours after the aging procedure $l_4$: at about 5 hours after the aging procedure This indicates that an operation point on the B-V properties varies with the lapse of time. However, to efficiently perform the aging procedure, it is preferable that some operation points corresponding to voltages properties are constant as much as possible.

FIG. 3 shows a graph representing changes in electroluminescence brightness with the lapse of time during the aging procedure when the conventional aging procedure using a constant voltage is performed.

FIG. 4 shows a graph representing changes in a voltage $V_{th}$ for starting to emit the electroluminescence of 1 foot-lambert (ft-L) with the lapse of time during the conventional aging procedure, from its initial value before the aging procedure. Normally, the voltage $V_{th}$ is in the order of about 150 V to about 190 V.

In order to shorten the aging time for sufficient results, the present inventors have offered the conception that an appropriate AC voltage pulse, for example, more than ($V_{th}$+30 volt) and less than ($V_{th}$+60 volt) is used for aging purposes.

However, according to the conventional aging procedure using the constant voltage, the B-V properties and the value of $V_{th}$ are changed as indicated in FIGS. 3 and 4, so that an electroluminescence intensity and the voltages are made insufficient. Even when an initial setting voltage is made higher to compensate for reductions of the intensity and the voltage, remarkable dielectric breakdown is generated in many thin-film EL display elements. Consequently, it was highly desired to shorten the aging time and compensate for the changes in the B-V properties and the value of $V_{th}$ of the thin-film EL display element.

SUMMARY OF THE INVENTION

Accordingly, it is an object of the present invention to provide an improved aging procedure applied to a thin-film EL display element.

It is another object of the present invention to provide an improved aging procedure applied to a thin-film EL display element for the purpose of completing the aging procedure with a shortened time and of compensating for changes in the B-V properties and the value of $V_{th}$.

Briefly described, in accordance with the present invention, a method of aging a thin-film electroluminescent (EL) display element comprises the steps of applying an aging voltage to electrodes of the element, and changing the peak value of the aging voltage in accordance with the characteristics of the element altered during an aging period. An aging circuit to enable the above method is provided. In a specific example, the magnitude of the aging voltage is changed according to the relationship between the brightness of electroluminescence generated from the element and a driving voltage applied to the element. In another specific example, the magnitude of the aging voltage is changed such that the brightness of the electroluminescence is sustained to be substantially constant, thereby making operation points constant on the above characteristics.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE INVENTION

Figure 1:
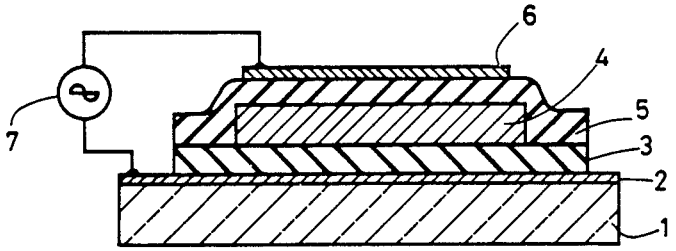
FIG. 1 shows a cross-sectional view of a basic thin-film EL display panel.
Figure 2:
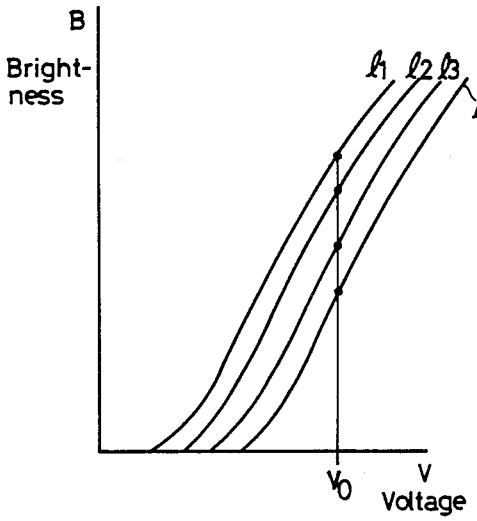
FIG. 2 shows a graph representing B-V properties of the thin-film EL display panel according to the conventional aging procedure.
Figure 3:
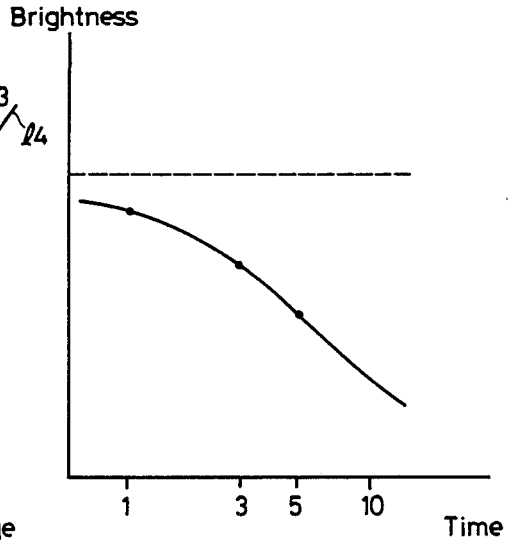
FIG. 3 shows a graph representing changes in electroluminescence brightness during the conventional aging procedure.
Figure 4:
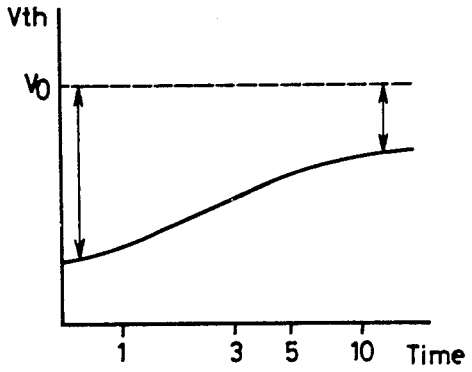
FIG. 4 shows a graph representing changes in a voltage $V_{th}$ for starting to emit electroluminescence of 1 foot-lambert (ft-L) during the conventional aging procedure from its initial value before the aging procedure.

As FIG. 4 shows, the voltage $V_{th}$ for starting to emit the electroluminescence of 1 foot-lambert (ft-L) varies during the conventional aging procedure.

Figure 5:
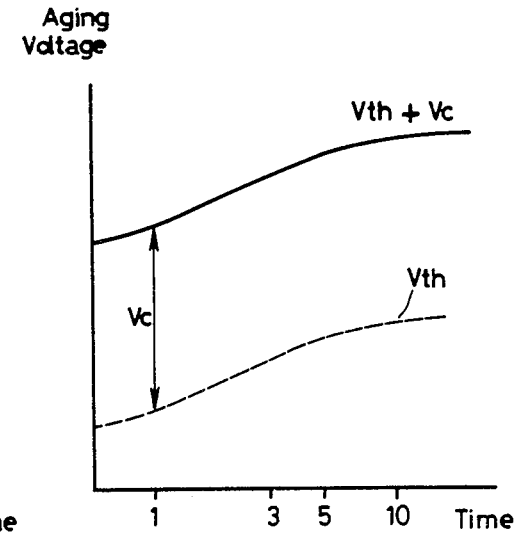
FIG. 5 shows a graph indicating changes in peak values of AC rectangular pulse signals applied to the thin-film EL display panel for aging purposes according to the present invention.

To compensate for this variation, as shown in FIG. 5, an aging voltage to be applied to the thin-film EL display panel varies in conformance with the variation of the voltage $V_{th}$ to be $(V_{th}+V_c)$ ($V_c$: constant). It is preferable that the constant voltage $V_c$ is selected to be in the order of about 15 V to about 80 V. More preferably, it is selected to be in the order of about 20 V to about 50 V. Normally, $V_{th}$ is in the order of about 150 V to 190 V.

Since the aging voltage varies in accordance with the change in the voltage $V_{th}$ according to the present invention, a sufficient voltage can be applied to the thin-film EL display panel during the aging period to suffice for aging.

Figure 6:
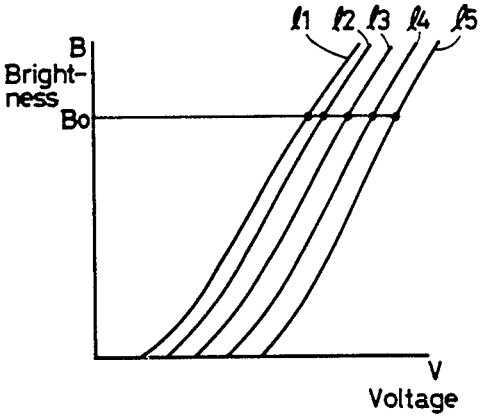
FIG. 6 shows a graph indicating electroluminescence brightness vs. applied voltage according to the present invention.

According to another preferred embodiment of the present invention, FIG. 6 shows a graph representing the B-V properties of electroluminescence, brightness vs. applied voltage of the thin-film EL display panel. In the graph of FIG. 6, the respective data are related to the following condition;

$l_1$: before the aging procedure $l_2$: at about 1 hour after the aging procedure $l_3$: at about 3 hours after the aging procedure $l_4$: at about 5 hours after the aging procedure $l_5$: just after the aging procedure.

According to the present invention, the electroluminescence brightness of the thin-film EL display panel during the aging procedure is set and controlled to be brightness $B_0$ which is set before the aging procedure. The aging voltage is changed such that the brightness Bo of the electroluminescence display panel is substantially sustained during the aging procedure. Therefore, the operation points on the B-V curve are made constant to improve the aging efficiency.

Figure 7:
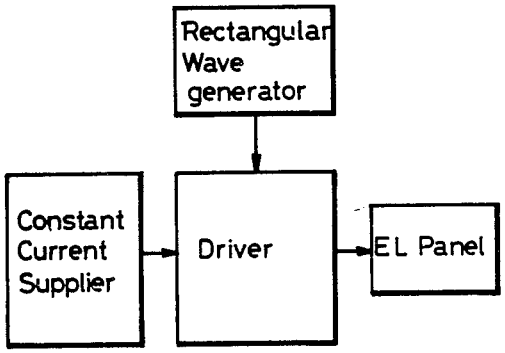
FIG. 7 shows a block diagram of an aging circuit according to the present invention.

FIG. 7 shows a block diagram of an aging circuit for providing the AC rectangular pulse signals as shown in FIG. 5.

In the aging circuit of FIG. 7, a constant current supplier is connected to a driver for driving the thin-film EL display panel. An AC rectangular wave generator is further connected to the driver. The generator is to generate AC rectangular signals.

The impendance Z of the thin-film EL display panel during the emission of the electroluminescence varies in accordance with the change in the B-V properties during the aging procedure. The changes in voltages are obtained by converting the changes in the impedances during the aging procedure using a formula of $V=I\cdot|Z|$ (I: the constant current, V: the aging voltage). Therefore, the aging voltage is changed as $(V_{th}+V_c)$ to follow the changes in the voltage $V_{th}$.

Thus, once the aging voltage is initially set, the aging voltage is increased to follow the changes in the voltage $V_{th}$.

While only certain embodiments of the present invention have been described, it will be apparent to those skilled in the art that various changes and modifications may be made therein without departing from the spirit and scope of the invention as claimed.

What is claimed is:

1. A circuit for aging a thin-film electroluminescent display element comprising:
   - a constant current circuit for providing a constant current to electrode means of an element;
   - rectangular wave generator means for providing rectangular waveform signals; and
   - converting means for converting changes in impedance of the element during an aging procedure into changes in applied voltages so that an aging voltage applied to the element is changed in accordance with changes in said impedance.

2. The circuit of claim 1, wherein the converting means varies said applied voltage in accordance with a formula of $V=I\cdot|Z|$: wherein
   - V: the voltage of the aging voltage
   - I: the constant current
   - Z: the impedance of the thin-film electroluminescent display element.

3. The circuit of claim 1, wherein the rectangular signals generated from the rectangular wave generator means are AC signals.

* * * * *